US005255004A

United States Patent [19]

Berkowitz et al.

[11] Patent Number: 5,255,004

[45] Date of Patent: Oct. 19, 1993

[54] LINEAR ARRAY DUAL POLARIZATION FOR ROLL COMPENSATION

[75] Inventors: Bernard Berkowitz, San Diego; Paul R. Eberhardt, Encinitas; David J. Miller, Santee, all of Calif.

[73] Assignee: Cubic Defense Systems, Inc., San Diego, Calif.

[21] Appl. No.: 756,454

[22] Filed: Sep. 9, 1991

[51] Int. Cl.[5] ..... H01Q 25/020; H01Q 21/240

[52] U.S. Cl. ..... 343/853; 343/770; 343/810; 343/814; 342/153

[58] Field of Search ..... 343/770, 771, 776, 797, 343/799, 810, 812–814, 853; 342/149, 153, 154, 361, 362

[56] References Cited

U.S. PATENT DOCUMENTS

| | | | |
|---|---|---|---|
| 4,051,474 | 9/1977 | Mack et al. | 342/362 |
| 4,196,436 | 4/1980 | Westerman | 343/770 |
| 4,197,541 | 4/1980 | Nemit et al. | 343/771 |

FOREIGN PATENT DOCUMENTS

| | | | |
|---|---|---|---|
| 0237244 | 7/1986 | German Democratic Rep. . | |
| 0101643 | 8/1979 | Japan | 343/771 |
| 8801062 | 2/1988 | World Int. Prop. O. . | |

*Primary Examiner*—Rolf Hille
*Assistant Examiner*—Peter Toby Brown
*Attorney, Agent, or Firm*—Brown, Martin, Haller & McClain

[57] ABSTRACT

A planar array of linearly polarized antenna elements, each element tilted so that its polarization orientation is disposed at an angle with respect to the array vertical axis so that array polarization loss is minimized as a function of roll about an array normal. Half of the elements are tilted uniformly at a positive angle with respect to the array vertical axis and the remaining elements are tilted at a negative angle with respect to the array vertical axis. The invention substantially reduces the unwanted variation in received RF energy magnitude as a function of array roll angle caused by polarization loss, for both vertical and horizontal components. The vertically polarized signal component magnitude remains nearly constant with respect to array roll angle values of 50°–60° and more. If the element tilt angle magnitude is between 0°–45°, the vertically polarized components from the two element groups are additive whereas the horizontally polarized components from the two groups are subtractive. Monopulse sum and difference outputs isolate the vertical and horizontal energy components. Broadside beam scanning without losing this roll compensation is possible if the two element groups are segregated into horizontal rows spanning the planar array.

17 Claims, 3 Drawing Sheets

LINEAR ARRAY DUAL POLARIZATION FOR ROLL COMPENSATION

BACKGROUND OF THE INVENTION

1. Field of the Invention

Our invention generally relates to means for roll-compensation in a mobile electromagnetic antenna array and, more specifically, to means for minimizing the roll polarization loss in an array of unipolar elements.

2. Description of the Related Art

The use of planar array seeker antennas on mobile platforms such as watercraft and aircraft is well-known in the art but introduces several difficult problems. One of these problems is the requirement to compensate for polarization loss in the antenna signal resulting from platform maneuvering about an axis parallel to the planar array normal. This requirement arises because of the linear polarization of the unipolar elements making up the planar array. Each array element provides an electrical output signal in response to an incident electromagnetic plane wave polarization component aligned with the polarization orientation of the unipolar antenna element in a manner well-known in the art. See, for instance, Warren B. Offutt, et al., "Chapter 23: Methods of Polarization Synthesis", Antenna Engineering Handbook, 2nd ed., Richard C. Johnson, et al., Eds., McGraw-Hill Book Company, 1984.

The use of a planar array configuration provides the advantage of increased sensitivity because of the directivity gain of such an array and the advantage of electronic steerability of the antenna beam given the appropriate beam steering electronics. The increased directivity makes such an antenna sensitive to platform maneuvering in yaw and pitch but automatic electronic beam steering techniques known in the art can easily compensate for the degradation of antenna sensitivity with yaw and pitch maneuvers. The polarization loss caused by roll maneuvering is not so easily overcome because it results from reduced sensitivity of the individual array elements to misaligned incoming signal polarization angles. Practitioners in the art have attempted to solve this problem by reducing element sensitivity to polarization alignment and also by physically holding the planar array stable in space during roll maneuvers of the aircraft.

The polarization of an electromagnetic wave is defined by the direction in which the electric vector is aligned during the passage of at least one full cycle. Generally, both the magnitude and direction of the electric vector will vary during each cycle and the electric vector will map out an ellipse in the plane normal to the direction of propagation. The direction of the major elliptical axis is the polarization orientation, which is normally defined as an angle $\beta$ from an arbitrary vertical. If the major and minor axes of the ellipse are equal, the wave is said to be circularly polarized. Also, if the minor axis is substantially zero in magnitude, the wave is said to be linearly polarized. Thus, a linearly polarized wave is defined as a transverse electromagnetic wave whose electric field vector at all times during the cycle lies along a fixed line at some tilt angle $\beta$ with respect to the vertical.

Any wave of arbitrary polarization can be synthesized from two unipolar waves of orthogonal polarization. A circularly polarized wave results from the combination of a vertically and a horizontally polarized wave of identical amplitude having a ninety (90°) degrees phase difference between them. The same waves having equal amplitude but no phase difference will combine to form a linearly polarized wave with a 45° orientation with respect to the vertical. Thus, as should be well-known in the art but is often confused, the use of a circularly polarized antenna element to detect a linearly polarized wave of arbitrary orientation will not alone avoid losses associated with changes in the phase relationship between the horizontal and vertical components of such an arbitrary wave. This problem limits the effectiveness of simple circularly polarized elements for planar array roll stabilization techniques involving isolation of polarization components, primarily because it is not suitable for planar arrays requiring off-axis beam-steering.

Nevertheless, previous solutions proposed for the problem of increasing polarization loss with roll angle for planar arrays of linearly polarized elements often rely on substitution of circularly polarized elements. A simple and well-known method for converting linearly polarized elements into a circularly polarized element is to orthogonally combine two such elements in quadrature by phase shifting one element output signal 90° before adding the second element output signal form a second orthogonally-disposed element. Such quadrature schemes require electronic circuits capable of adjusting the signal time delay as a function of carrier frequency, which is known to be complex and difficult as well as expensive. Alternatively, two such orthogonal elements can be displaced by one-quarter wavelength along an axis in the direction of propagation, thereby achieving the necessary 90° quadrature phase shift between elements, but such a physical spacing is accurate at only a single frequency.

It is also well-known that circular polarization can be achieved by a combination of dissimilar electromagnetic antennas if the fields produced are equal in magnitude and in time-phase quadrature. A simple example of such a combination is the horizontal loop and a vertical monopole. In practice, this combination is useful only over narrow bandwidths because of dissimilar impedance characteristics.

Another circularly polarized combination known in the art consists of two vertical half-wavelength cylinders in which vertical slots are cut. The two cylinders provide a vertically polarized omnidirectional pattern and the two slots give a horizontally polarized pattern in the same plane. If the two radiated signals are carefully adjusted so that they are in time-phase quadrature, the resulting pattern will be circularly polarized.

Several other circular polarization techniques are known in the art, but most provide circular polarization only on axis and all such techniques tend to be limited in bandwidth because of the precise phase relationships required between the combined elements.

The second scheme known in the art for minimizing polarization losses during roll maneuvers includes methods for physical array antenna stabilization during roll maneuvers. These methods vary in complexity and effectiveness but generally involve inertial sensing means in combination with rotational motor means for rotating the planar array antenna about the aircraft roll axis to stabilize the physical antenna orientation with respect to a stable reference frame. Obviously, the cost, complexity and reliability of these schemes makes them generally less desirable than other non-mechanical solutions to the roll-compensation problem.

The simplest and least expensive solution to the general problem of polarization loss would ideally involve an array of linearly polarized elements that requires no special phase shift circuitry and no quadrature summation means. For instance, U.S. Pat. No. 3,283,330 issued to Maurice G. Chathelain on Nov. 1, 1966, discloses an omnipolarization microstrip antenna that is simple and economical to manufacture using minimal components. Chathelain attains this simplicity by using linearly polarized elements arranged along a microstrip to provide omnipolarization characteristics to an endfire array pattern. Chathelain teaches the use of an array of monopoles extending from a ground plane and inclining outwardly from said microstrip. The spacing of his inclined monopoles is staggered on either side of the microstrip as necessary to provide the phase relationship required for circular polarization of radiation propagated at endfire. However, Chathelain's technique is not applicable for planar arrays having broadside or beamsteered radiation patterns. Moreover, Chathelain's technique is limited to monopole elements and is not practical for application to arrays using slot radiator elements or other linearly polarized elements known in the art.

The use of unipolar elements disposed with a tilted polarization orientation with respect to the vertical array axis has been suggested in the prior art for a variety of purposes but all such planar array techniques teach the use of identical element tilts throughout the entire array. Such an identical tilt scheme does nothing to control polarization loss with respect to roll angle because, as mentioned above, merely tilting a series of linearly polarized elements is nothing more than a change to the effective direction of the arbitrary vertical reference and has no effect on antenna sensitivity to misaligned polarization components. Thus, there is a strongly felt need in the art for a simple, inexpensive and accurate means for overcoming the polarization loss associated with roll maneuvers with planar array aircraft antennas. These unresolved problems and deficiencies are clearly felt in the art and are solved by our invention in the manner described below.

SUMMARY OF THE INVENTION

Our invention provides for a nearly constant output signal as a function of platform roll for an arbitrarily polarized incoming electromagnetic wave. We accomplish this by using a planar array of linearly polarized or unipolar elements without using circular polarization means known in the art, thereby saving weight and complexity.

Each element in our invention is oriented at a tilt angle with respect to the array vertical axis. This allows simultaneous reception (or transmission) of both vertical and horizontal energy polarization components. We improve on the prior art by using unipolar element tilt angles of equal but opposite magnitude on either half of the planar array. That is, in our preferred embodiment, all elements on the left half of the array tilt inwardly toward the array center line at a uniform and fixed tilt angle while all elements on the right half of the array also tilt inwardly toward the centerline at the same fixed angle. This results in the left half of the elements receiving a horizontal component equal but opposite from the horizontal component received by the right half of the elements. Of course, the elements may be distributed at random in the array so long as the left-tilting element outputs are segregated from the right-tilting element outputs.

Three important effects result from our invention. First, the variation in magnitude of received (or transmitted) electromagnetic energy is greatly reduced as a function of support vehicle or platform roll angle about an axis normal to the planar array. With our invention, the variations with roll angle for both horizontal and vertical components are related such that the ratio of the vertical polarization magnitude to horizontal polarization magnitude remains nearly constant with respect to roll angle.

Secondly, the two opposing tilt angles affect the signs of the received signal components differently. Thus, the vertical components received on both sides of the array are identical whereas the horizontal components received on either side are opposite in sign (that is, 180° out of phase).

Finally, we provide monopulse sum and difference outputs in our invention at the ports of a 180° hybrid summation circuit for both the left and right sides of the array. The 180° monopulse sum output is then proportional to the vertical polarized component of the incoming signal whereas the 180° monopulse difference output is proportional to the horizontally polarized component of the incoming signal. With identical tilt angle magnitudes and symmetrical geometry between the two halves of the array, the horizontally polarized components of the two output signals are canceled in the monopulse sum output and the vertical polarized components of the two output signals are canceled in the monopulse difference output. Thus, our invention simply and inexpensively detects and separates the vertical and horizontally polarized components of the incoming electromagnetic signal without bandwidth limitations related to quadrature summation requirements.

An important advantage of our invention is that the polarization loss verses roll angle is relatively constant from small to large roll angles. Another advantage of our invention is the elimination of any requirement for array stabilization to compensate for platform roll. Yet another advantage of our invention is that it controls polarization loss during any broadside beam scanning that uses standard planar array beam steering techniques known in the art and is not limited in application to the boresight beam direction.

An important feature of our invention is that our technique is applicable to planar arrays of any sort of unipolar elements known in the art, such as monopoles, dipoles, slot radiators and so forth. Another important feature of our invention is that the horizontal and vertical polarization components can be separately detected and processed to compensate for roll polarization losses.

The foregoing, together with other features and advantages of our invention, will become more apparent when referring to the following specifications, claims and the accompanying drawings.

BRIEF DESCRIPTION OF THE DRAWINGS

For a more complete understanding of our invention, we now refer to the following detailed description of the embodiments illustrated in the accompanying drawings, wherein.

DESCRIPTION OF THE PREFERRED EMBODIMENTS

Figure 1:
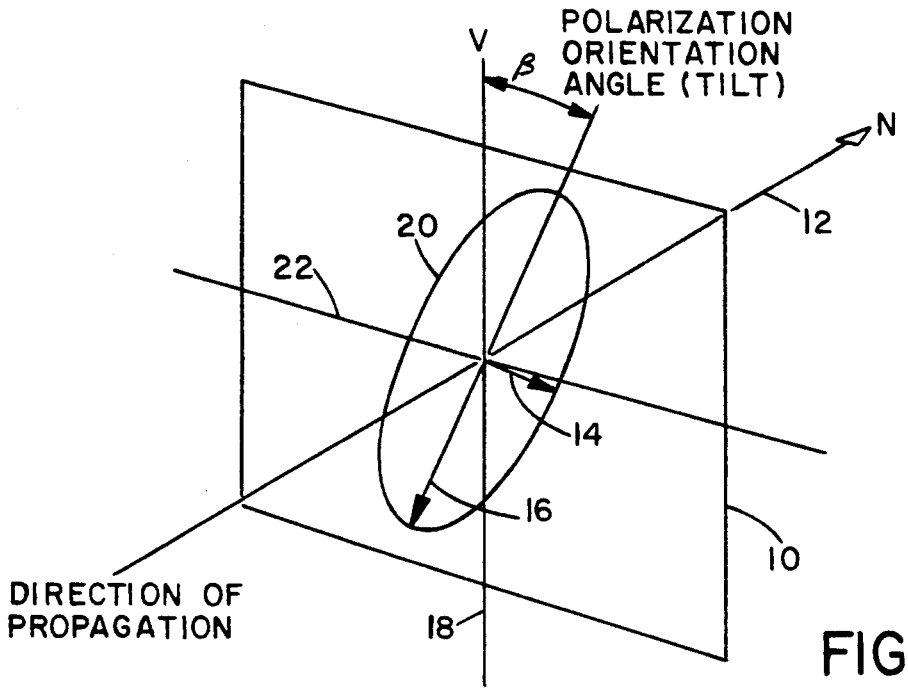
FIG. 1 shows the coordinate system used in our discussions of electromagnetic wave polarization and array element tilt angles.

FIG. 1 illustrates the coordinate system used in the following discussions of electromagnetic wave polarization and unipolar array element tilt angles. The array plane 10 is oriented orthogonally to the direction of propagation 12 of an elliptically polarized electromagnetic wave. Direction of propagation 12 also represents a normal N to array plane 10. The elliptically polarized electromagnetic wave can be decomposed into a minor component 14 and a major component 16. Components 14 and 16 are orthogonal and major component 16 is oriented at a tilt angle $\beta$ from the array vertical 18. Array vertical 18 also represents the vertical center line V of array plane 10, As is known in the art, the electric field vector of any elliptically polarized electromagnetic wave rotates about array normal N in either a clockwise or a counterclockwise direction, making one complete rotation over a distance of one wavelength along the direction of propagation 12. The electric field vector rotation describes a tilted ellipse 20 as shown in FIG. 1. Either major component 16 or minor component 14 may be described in terms of two orthogonal basis vectors oriented along array vertical 18 and an array horizontal 22, as is well-known in the art. Thus, it can be appreciated that minor component 14 can be expressed as a combination of a horizontally polarized component and vertically polarized component as can major component 16. The elliptically polarized electromagnetic wave may therefore also be described in terms of two orthogonal components oriented along array axes 18 and 22.

Continuing with FIG. 1, consider a single linearly polarized (unipolar) antenna element (not shown) oriented in array plane 10 such that the element polarization orientation lies at angle $\beta$ with respect to array vertical 18. Such an element would detect major component 16 of an elliptical wave oriented at angle $\beta$ but would not detect any portion of minor component 14. If array plane 10 were then rolled or rotated about array normal 12, the output of such an element would vary elliptically as the element polarization orientation is rotated through the various angles describing ellipse 20. The change in such element response as a function of roll angle is referred to as polarization loss in the art.

Figure 2:
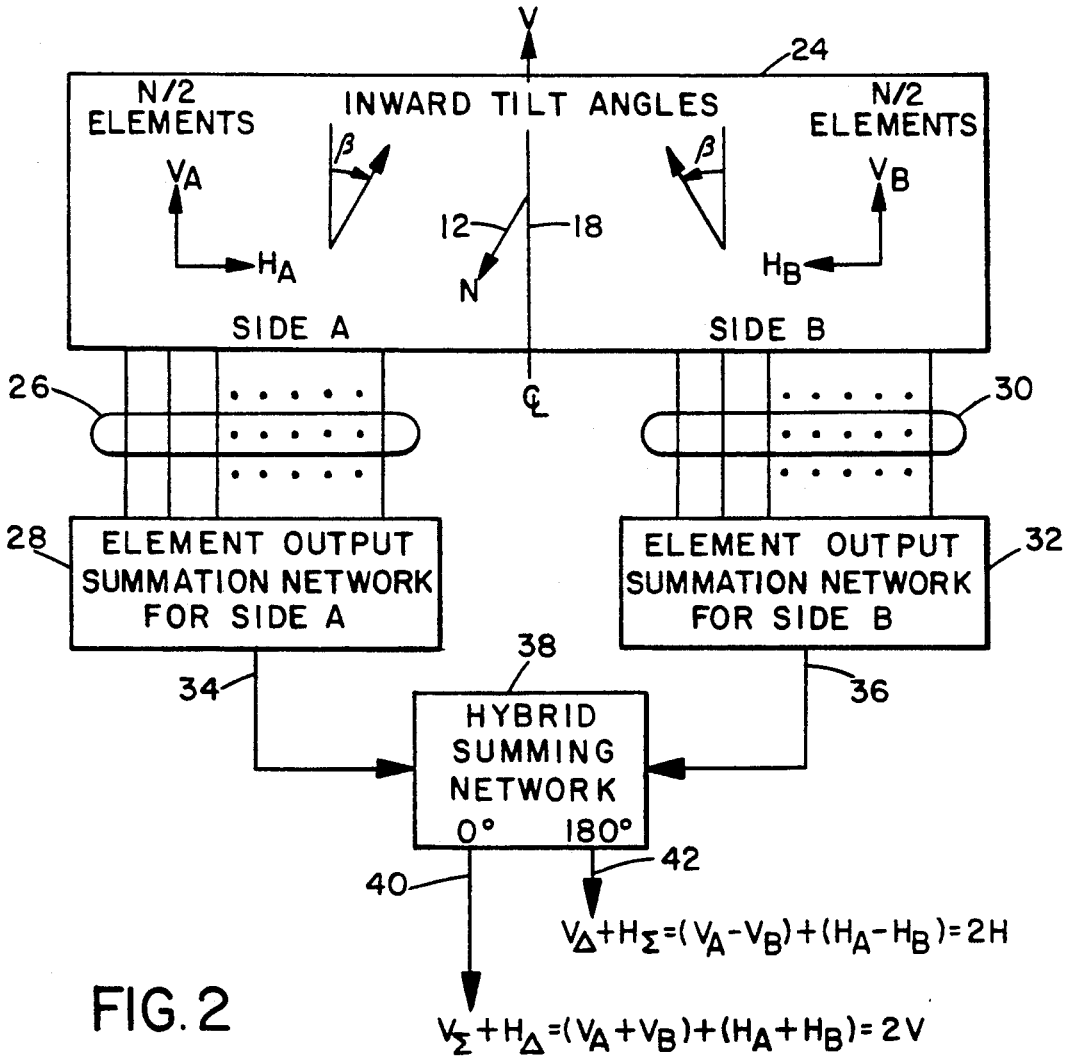
FIG. 2 shows a schematic block diagram of the preferred embodiment of our invention.

In FIG. 2, we illustrate the preferred embodiment of our invention in diagrammatic form. The planar array 24 is shown organized into sides A and B. Sides A and B are separated by array vertical 18 and comprise equal numbers of unipolar elements (not shown). Every unipolar element in array 24 has a polarization orientation disposed at angle $\pm\beta$ with respect to array vertical 18. In the preferred embodiment of our invention, all elements are tilted inwardly toward array vertical 18 at tilt angle $\beta$. As shown schematically in FIG. 2, this means that all array elements (not shown) on side A have a polarization orientation that may be described in terms of vertical and horizontal components $V_A$ and $H_A$. Similarly, array elements (not shown) on side B have polarization orientations expressible in terms of array vertical and horizontal components $V_B$ and $H_B$.

Because all array elements are unipolar, the electrical output signal from each array antenna element (not shown) will be proportional to the incoming electromagnetic wave portion that is aligned along the direction of the element polarization orientation, as is well-known in the art. The element output signals 26 from array side A are then collected in a first summing network 28. Similarly, the element output signals 30 from array side B are connected to the second summing network 32. For simple broadside patterns, networks 28 and 32 merely sum output signals 26 and 30 to form a first sum signal 34 comprising the outputs from all elements on array side A and a second sum signal 36 comprising the outputs from all elements on array side B.

Much of the usefulness of our invention relates to polarization loss roll compensation during planar array beam steering using array element phase delay networks in a manner well-known in the art. For instance, see Mark T. Ma, "Chapter 3: Arrays of Discrete Elements", *Antenna Engineering Handbook*, 2 ed., Richard C. Johnson, et al., Eds., McGraw-Hill Book Company, 1984. See also Theodore C. Cheston, et al., "Chapter 11: Array Antennas", *Radar Handbook*, Merril I. Skolnik, Ed., McGraw-Hill Book Company, 1970. These citations are incorporated herein by reference in their entirety.

An important and useful feature of our invention is that networks 28 and 32 may comprise any suitable phase shifting means for steering the main array antenna pattern beam array 24 in any direction with respect to array normal 12. Thus, first and second sum signals 34 and 36 can represent samples of electromagnetic waves arriving from any direction. Our invention is not limited to broadside arrivals as are arrays of circularly polarized elements and many other devices proposed as solutions to the roll compensation polarization loss problem.

Once we obtain first and second sum signals 34 and 36, we connect them to a third summing network 38, which should be a hybrid summing network of the type known in the art for monopulse antennas. FIG. 2 shows the effect of summing first and second sum signals 34 and 36 in phase and with 180° phase reversal. The 0° phase summation creates a monopulse sum signal 40 and the 180° phase summation creates a monopulse difference signal 42.

Monopulse signal 40 comprises the sum of all vertically polarized components received on sides A and B, represented in FIG. 2 as $V_\Sigma$, together with the difference of the magnitudes of the two horizontal components $H_A$ and $H_B$, represented as $H_\Delta$. Examination of the relationship between the element polarization orientation on sides A and B leads to the equation for signal 40 in FIG. 2, which demonstrates that monopulse sum signal 40 is always proportional to the vertically polarized component of elliptical electromagnetic signal 20. Similar reasoning leads to the other equation for signal 42, which shows that to monopulse difference signal 42 is always proportional to the horizontally polarized component of elliptical electromagnetic signal 20.

The above discussion is also applicable to the operation of array 24 as a transmitter, where signals 40 and 42 represent the vertical and horizontal polarization components desired for the transmitted electromagnetic wave.

Our invention as shown in FIG. 2 can be used to compensate for polarization loss resulting from rolling of array 24 about an axis aligned with array normal 12. This can be appreciated by considering the changes in monopulse signals 40 and 42 as array 24 as rolled about array normal 12. As polarization losses cause a reduction in monopulse sum signal 40, the same phenomenon causes an increase in monopulse difference signal 42. Thus, the available signal-to-noise ratio (SNR) is not degraded as a result of the rolling maneuvers of the platform carrying array 24. Signals 40 and 42 can be combined as necessary, using signal processing techniques known in the art, to compensate for such rolling maneuvers.

Figure 3:
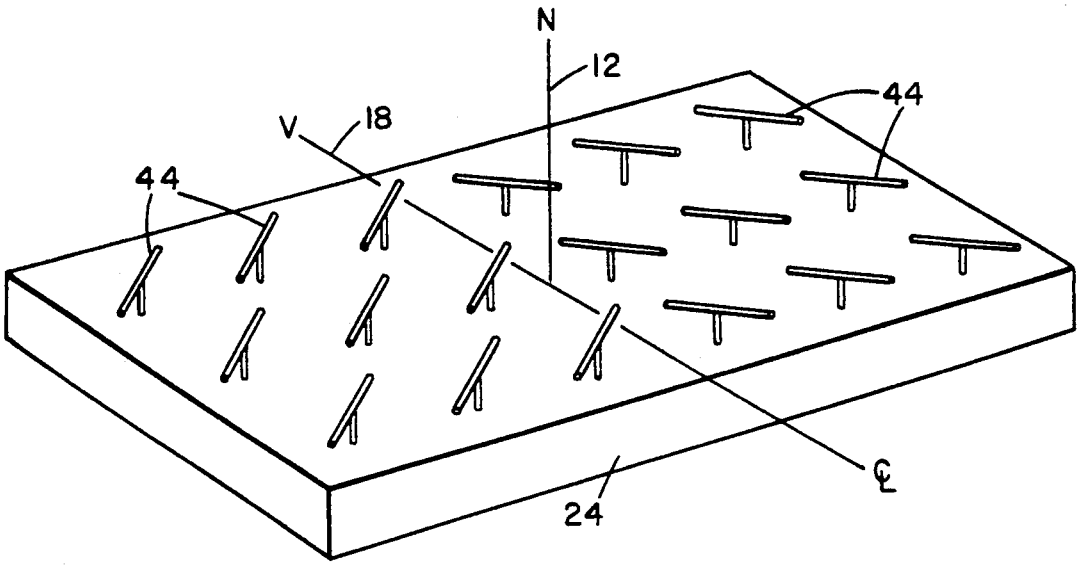
FIG. 3 shows an oblique view of an illustrative embodiment of our invention using dipole elements.

In FIG. 3, we illustrate a useful disposition of the array elements 44 on planar array 24. Array elements 44 are shown as simple dipole antennas tilted inwardly toward array vertical 18. Elements 44 are organized into rows and columns to permit inexpensive implementation of suitable planar array beam steering algorithms. Elements 44 are tilted at approximately 45° with respect to array vertical 18, which is a useful value for tilt angle $\beta$ discussed above. Tilt angle $\beta$ of elements 44 need not be identical throughout each side of the array, but must be of opposite sign with respect to vertical 18 on either side of the array in our preferred embodiment.

Figure 4:
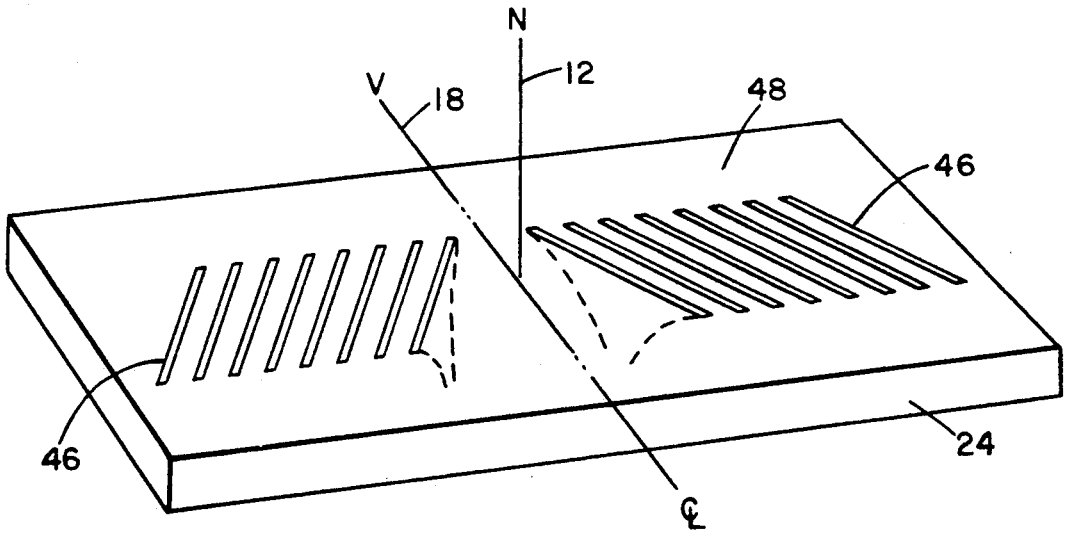
FIG. 4 shows an oblique view of the preferred embodiment of our invention using an array of exponential slot radiators having 45° inward tilt angles.

FIG. 4 illustrates an alternative preferred embodiment of our invention comprising an array of exponential slot elements 46 of a type well-known in the art. Each exponentially-tapered slot element 46 is fed from the center and is independently connected to a summing network (not shown) in the manner discussed for FIG. 2. Slots 46 are cut into a conducting surface 48 of array 24 and are organized as a single row with each element 46 tilted at a 45° angle with respect to array vertical 18. The elements on each side of array 24 are tilted inwardly toward the array centerline lying on array vertical 18.

Figure 5:
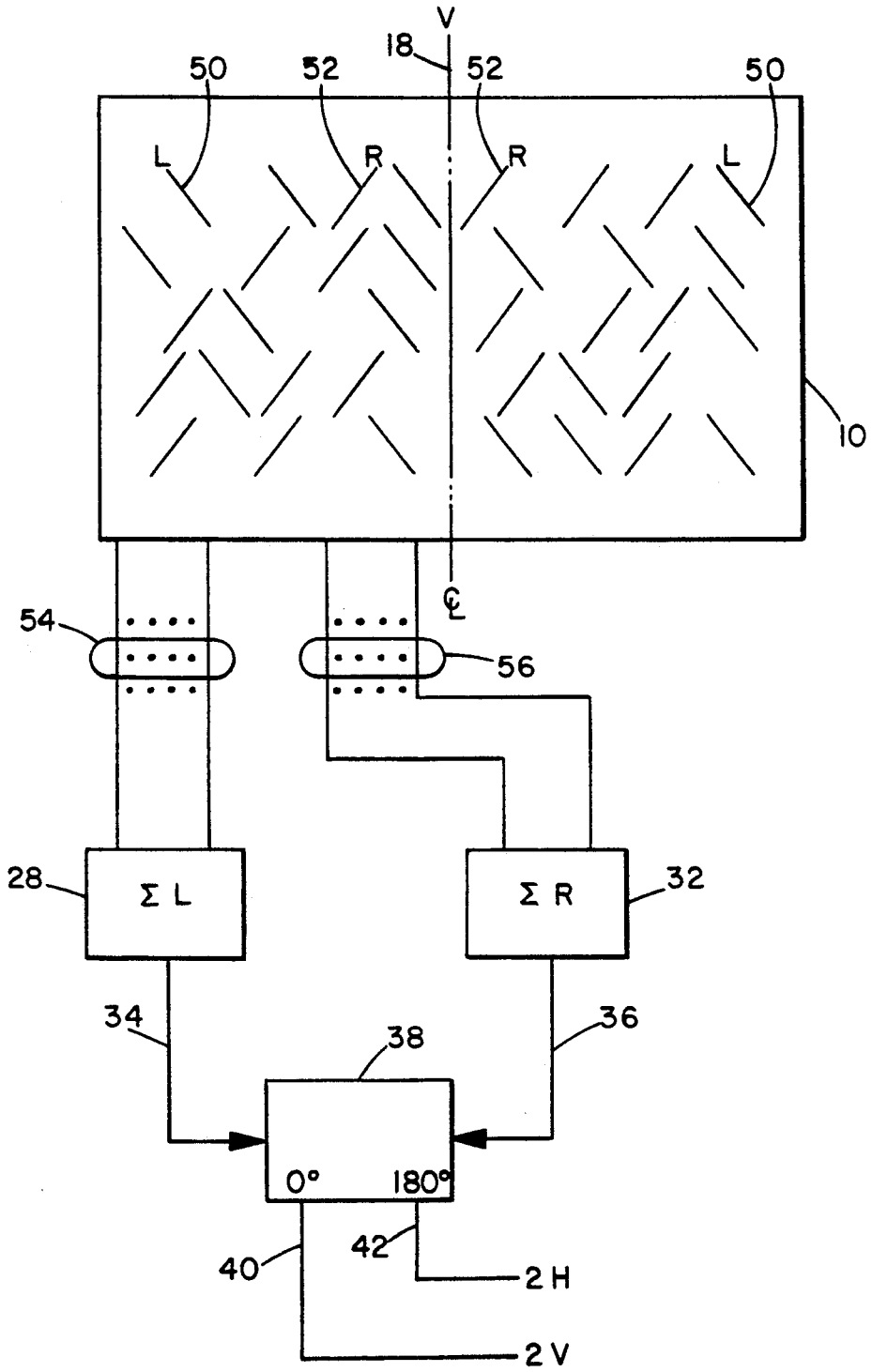
FIG. 5 shows an illustrative embodiment of our invention using randomly distributed elements.

FIG. 5 illustrates an alternative embodiment of our invention wherein the leftwardly tilted elements 50 and the rightwardly tilted elements 52 are randomly distributed in array plane 10 on either side of array vertical 18. Although elements 50 and 52 are randomly distributed, our invention requires that substantially equal numbers of each element tilt angle be represented over array plane 10.

The leftwardly tilted element output signals 54 are all connected to a first summing network 28 and the rightwardly tilted element output signals 56 are all connected to second summing network 32. Thus, although elements 50 and 52 are randomly disposed in array plane 10, the connections and summations through networks 28 and 32 result in signals 34 and 36 with characteristics similar to those discussed in connection with FIG. 2. Third summing network 38 operates as was discussed in connection with FIG. 2 to provide monopulse sum signal 40 and monopulse difference signal 42. Signals 40 and 42 are directly proportional to the vertical and horizontal polarization components of the incoming electromagnetic wave as was discussed in connection with the embodiment shown in FIG. 2.

Obviously, other embodiments and modifications of our invention will occur readily to those of ordinary skill in the art in view of these teachings. Therefore, our invention is to be limited only by the following claims, which include all such obvious embodiments and modifications when viewed in conjunction with the above specification and accompanying drawings.

We claim:

1. A planar array having a vertical center line in the array plane, said array comprising:

at least one row of linearly polarized antenna elements disposed in said array plane with an equal number of said elements disposed on first and second sides of said center line, each said element on said first side corresponding to one said element on said second side;

each said element disposed such that its polarization orientation is tilted at an angle with respect to said vertical center line, said tilt angles of said corresponding elements having opposite signs and magnitudes greater than 0° and less than 90°;

first summing means for adding the output signals from all said elements on a first said side to form a first sum signal;

second summing means for adding the output signals from all said elements on the second said side to form a second sum signal; and third summing means for combining said first and second sum signals to form a monopulse sum signal and a monopulse difference signal.

2. The planar array described in claim 1 wherein:

said tilt angles are identical for all said elements on a single said side.

3. The planar array described in claim 2 wherein:

each said element tilt angle is disposed inwardly toward said center line.

4. The planar array described in claim 3 wherein:

each said row is disposed orthogonally to said center line.

5. The planar array described in claim 4 further comprising:

phase delay means for steering the primary array pattern lobe at an angle with respect to an array normal.

6. The planar array described in claim 1 wherein:

each said antenna element comprises a center-fed unipolar exponential slot radiator.

7. The planar array described in claim 3 wherein:

said inward element tilt angle is inwardly disposed by an identical amount on each said side.

8. The planar array described in claim 2 wherein:

each said element tilt angle is disposed outwardly away from said center line.

9. The planar array described in claim 8 wherein:

said outward tilt angle is outwardly disposed by an identical amount on each said side.

10. The planar array described in claim 2 wherein:

the magnitude of each said element tilt angle is equal to 45°.

11. The planar array described in claim 1 wherein:

each said element tilt angle is disposed inwardly toward said center line.

12. The planar array described in claim 1 wherein:

each said element tilt angle is disposed outwardly away from said center line.

13. The planar array described in claim 1 wherein:

each said element row is disposed orthogonally to said center line.

14. The planar array described in claim 1 further comprising:

phase delay means for steering the primary array pattern lobe at an angle with respect to an array normal.

15. A planar array having a vertical axis and a horizontal axis, said array comprising:

a plurality of linearly polarized antenna elements disposed in said array plane such that the polarization orientation of each said element is titled at an angle with respect to said vertical array axis, said angle having a magnitude equal to 45°;

wherein half of said elements are disposed on each side of said vertical array axis, said vertical array axis not intersecting any of said antenna elements;

wherein half of said elements are tilted in a first horizontal direction and all remaining said elements are tilted in the second horizontal direction;

first summing means for adding the output signals from all said elements having a tilt angle in said first horizontal direction to form a first sum signal;

second summing means for adding the output signals from all said elements having a tilt angle in said second horizontal direction to form a second sum signal; and third summing means for combining said first and second sum signals to form a monopulse sum signal and a monopulse difference signal.

16. The planar array described in claim 15 further comprising:

phase delay means for steering the primary array pattern lobe at an angle with respect to an array normal.

17. The planar array described in claim 16 wherein:

each said antenna element comprises a center-fed unipolar exponential slot radiator.

* * * * *